United States Patent [19]

Hoss

[11] Patent Number: 4,699,280

[45] Date of Patent: Oct. 13, 1987

[54] SHIPPING RACK CONVERTIBLE TO FIRST AND SECOND LENGTHS

[75] Inventor: Donald A. Hoss, Southfield, Mich.

[73] Assignee: Chrysler Motors Corporation, Highland Park, Mich.

[21] Appl. No.: 912,291

[22] Filed: Sep. 29, 1986

[51] Int. Cl.[4] ..... A47F 5/00

[52] U.S. Cl. ..... 211/195; 108/54.1; 211/175

[58] Field of Search ..... 108/55.1, 53.1, 54.1, 108/56.1; 211/175, 195, 194

[56] References Cited

U.S. PATENT DOCUMENTS

| | | | |
|---|---|---|---|
| 3,565,018 | 2/1971 | Jay | 108/53.1 |
| 3,857,494 | 12/1974 | Giardini | 108/55.1 X |
| 4,537,421 | 8/1985 | Teachout | 211/195 X |

*Primary Examiner*—Robert W. Gibson, Jr.
*Attorney, Agent, or Firm*—Edward A. Craig

[57] ABSTRACT

A shipping rack is provided which is convertible to a first rack length for snug lengthwise loading across the interior width of a semi-trailer and convertible to a second rack length for snug loading lengthwise across the interior width of a railroad boxcar. This is accomplished by providing pivotable extensions on one end wall of the rack which may be pivoted into the end wall to form a short rack length and out of the end wall to form a longer rack length.

4 Claims, 7 Drawing Figures

SHIPPING RACK CONVERTIBLE TO FIRST AND SECOND LENGTHS

BACKGROUND OF THE INVENTION

1. Field of the Invention

This invention relates to a shipping rack convertible to a first rack length for loading onto a semi-trailer and convertible to a second length for loading onto a railroad boxcar.

2. Prior Art

Racks of the type to which the present invention relates are commonly used for shipping industrial parts. The parts are normally elongated members which do not readily fit into box-like containers. For example, automobile bumpers are elongated and have a curved configuration which does not readily adapt to shipment in box-like containers. The racks used for this purpose normally have a bottom wall and upstanding end walls but no sidewalls. The elements to be shipped can be easily loaded onto the racks with the racks giving vertical and endwise support.

Loaded racks are normally shipped in conventional semi-trailers and railroad boxcars. The semi-trailers referred to are of the type normally pulled by a tractor on highways or, in some cases, shipped for long distances on railroad flat cars.

Both semi-trailers and railroad boxcars have assumed a relatively conventional width. For example, standard railroad boxcars have an interior width of about one hundred ten inches while many semi-trailers have an interior width of about ninety-eight inches. Racks are normally stowed in either railroad boxcars or semi-trailers lengthwise across the width of the railroad boxcar or semi-trailer. There must be a relatively snug fit of the racks across the width of these units so that the racks will not shift within the transporting unit for any appreciable distance while the unit is moving. Such shifting, if it gained momentum by traveling a foot or so within the transporting unit could cause severe damage to the unit possibly rupturing the sidewalls. It is, however, desired to have a small clearance between the ends of the racks and the sidewalls of the transporting unit, to facilitate loading and unloading and also to accommodate the small discrepancies in standard width which are encountered in practice. Two inches is normally considered adequate clearance.

In the past, two different sets of racks have had to be used to transport industrial parts in semi-trailers and railroad boxcars. The racks for semi-trailers have been about ninety-six inches in length while the racks for railroad boxcars have been about one hundred eight inches in length. This obviously requires industrial and shipping concerns to stock different size racks and, in addition to the cost of such racks, inhibits flexibility in loading and shipping materials. Thus, racks of railroad boxcar size might be available when it is desired to ship on semi-trailers or vice-a-versa.

In accordance with the present invention, a shipping rack is provided which may be used for loading either semi-trailers or railroad boxcars. The basic rack length is fashioned to be of a size desirable for semi-trailers in view of the fact that such trailers are narrower than railroad boxcars. However, extensions which are pivotable out of one of the end walls of the racks are provided to effectively increase the length of the rack so that it may be utilized for shipment via railroad boxcars. There is, of course, a certain amount of unused space in the boxcar when such extensions are used. However, the overall benefits derived from the lack of need for stocking two sizes of racks and the flexibility in use of the racks override this factor.

SUMMARY OF THE INVENTION

A shipping rack is provided which is convertible to a first rack length for snug lengthwise loading across the interior width of a semi-trailer and convertible to a second rack length for snug loading lengthwise across the interior width of a railroad boxcar. The rack comprises a bottom wall having a width and a length. An upstanding end wall is provided at each end of the length of the bottom wall. The distance between the outside surfaces of the end walls define the first rack length.

A pair of spaced apart rack extensions are pivotally mounted on one of the end walls. The rack extensions are pivotable to one position where they are folded into the end wall and define with the end wall the first rack length. The rack extensions are pivotable to a second position where they extend outwardly from the outside surface of the end wall in which position the distance between the outer edge surfaces of the extensions and the outer surface of the outer end wall define the second rack length. The first rack length is about ninety-six inches and the second rack length is about one hundred eight inches.

One edge of each extension comprises an elongated generally vertically extending member having a pair of spaced apart enlarged multi-sided locking elements thereon. A pair of vertically spaced apart tubular latching elements are mounted on the end wall. The extension edge is pivotally and slidably received in the latching elements with each of the locking elements being positioned above one of the locking elements when the extension edge is moved upwardly to permit pivoting of the edge of the latching elements, and thus the extensions, to either the first or said second position. The interior of each latching element is of a size to slidably receive a locking element and has a mating surface configuration to prevent pivoting of the edge when the locking element is received therein upon downward movement of the edge.

Stop means are provided on each extension to abut the latching elements to limit downward movement of the extensions. Additional stop means are provided on the end wall to abut against the extensions and limit upward movement. The edge member of each extension has an extended lower portion to prevent escape from its respective latching element prior to such abutment with the stop means on the end wall.

BRIEF DESCRIPTION OF A PREFERRED EMBODIMENT

Figure 1:
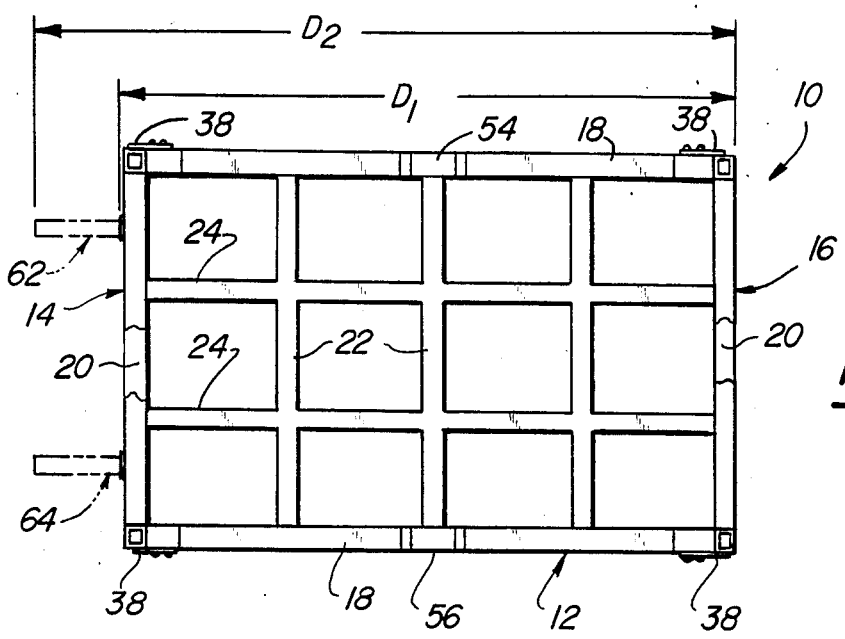
FIG. 1 is a top plan view of a shipping rack forming one embodiment of the present invention.

Referring to the drawings, it will be noted that the shipping rack 10 includes a bottom wall 12 having a width and a length with an upstanding end wall 14, 16 at each end of the length of the bottom wall. The bottom and end walls are made to be fabricated of welded tubular steel. Plastic materials may alternatively be used for fabrication purposes.

The bottom wall 12 comprises a frame consisting of side rail members 18 and end rail members 20. Extending between these members are lateral elements 22 and longitudinal elements 24 which define a grid-like pattern. As will be appreciated, the bottom wall 12 provides vertical support for materials which are loaded thereon.

Each of the end walls comprises a frame consisting of upper and lower rails 26, 28 and vertical end rails 30, 32. Again, these elements may be fabricated of tubular steel and welded together. Feet 34, 36 extend from the lower end of the vertical rails 30, 32. As will be noted in dotted lines, one rack 10 may be loaded on another rack with the feet being received in the hollow upper ends of the tubular vertical rails. The end walls are secured to the bottom wall by means of a plates 38. The plates are welded at one end 42 to the vertical rails of the end walls. The other ends of the plates are bolted to the bottom wall by means of nut and bolt structures 44 which are secured to projections 46 which are welded to the ends of the bottom wall rails 18. This permits pivoting of the end walls with respect to the bottom wall. As will be seen in FIG. 2, opening means 48 are provided through the plates 38 and projections 46. A pin 50 is received through the opening means 48 and held in place by cotter pin 52 to normally lock the end walls in the upright position shown. When the racks are empty and it is desired to store them, the pin 50 may be removed and the end walls folded into the bottom wall as shown in dotted lines. Support members 54, 56 are provided on the bottom wall for support of the collapsed end walls. A pair of spaced apart loops 58, 60 are provided at each end of the bottom wall to facilitate manipulation of the racks by means of a fork lift truck.

Figure 7:
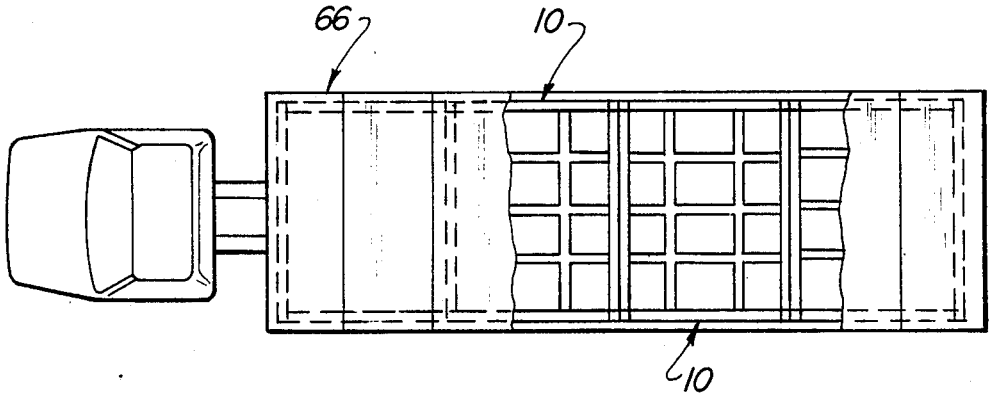
FIG. 7 is a top plan view of a semi-trailer with portions of the top removed to illustrate loading of shipping racks of the present invention therein.

A pair of spaced apart rack extensions 62, 64 are pivotally mounted on the end wall 14. As will be noted in FIGS. 2 and 5, the rack extensions are pivotable to one position where tney are folded into the end wall 14 and pivotable to a second position where they extend outwardly from the outside surface of the end wall 14. Referring to FIG. 1, the distance $D_1$ represents the first rack length which is provided for snug lengthwise loading across the interior width of a semi-trailer 66 as shown in FIG. 7. The interior widrh of a standard semi-trailer of the type in which such racks are normally transported is about ninety-eight inches. The rack length $D_1$, which represents the distance between the outside surfaces of the end walls 14, 16, is about ninety-six inches. This leaves two inches to spare for loading and unloading of the racks and also takes care of minor discrepancies in the interior width of the semi-trailer 66.

Figure 6:
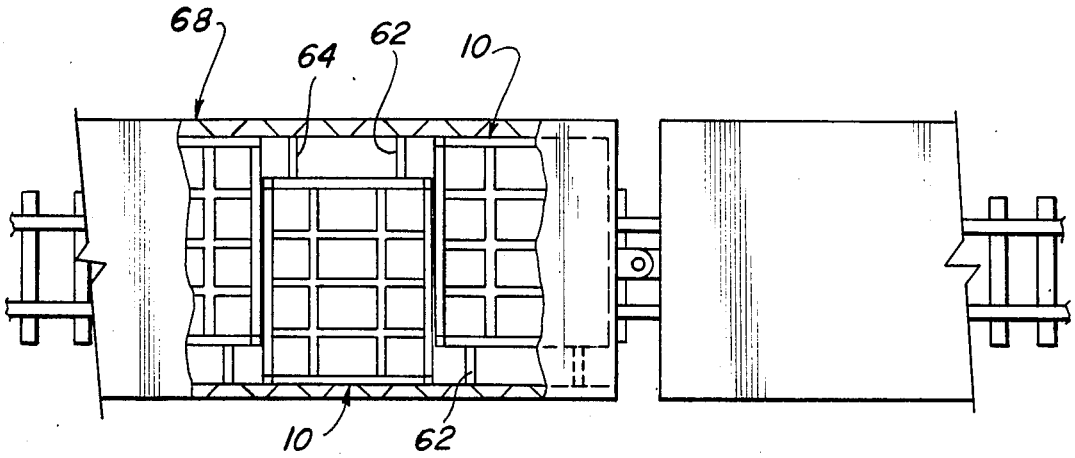
FIG. 6 is a top plan view of a railroad boxcar with portions of the top removed to illustrate loading of shipping racks of the present invention therein.

When the extensions 62, 64 are pivoted outwardly as shown in FIG. 1, the distance $D_2$ represents the second rack length. This length is appropriate for snug loading of the racks lengthwise across the interior width of a railroad boxcar 68 as illustrated in FIG. 6. The interior width of a standard boxcar is about one hundred ten inches. The rack length $D_2$ is about one hundred eight inches. Again, two inches are provided for facilitating loading and unloading and to take care of minor discrepancies in the interior width of boxcars. The distance $D_2$ is measured from the outer surface of the end walls 16 to the outer edge surface of the extensions 62, 64 as shown.

Figure 2:
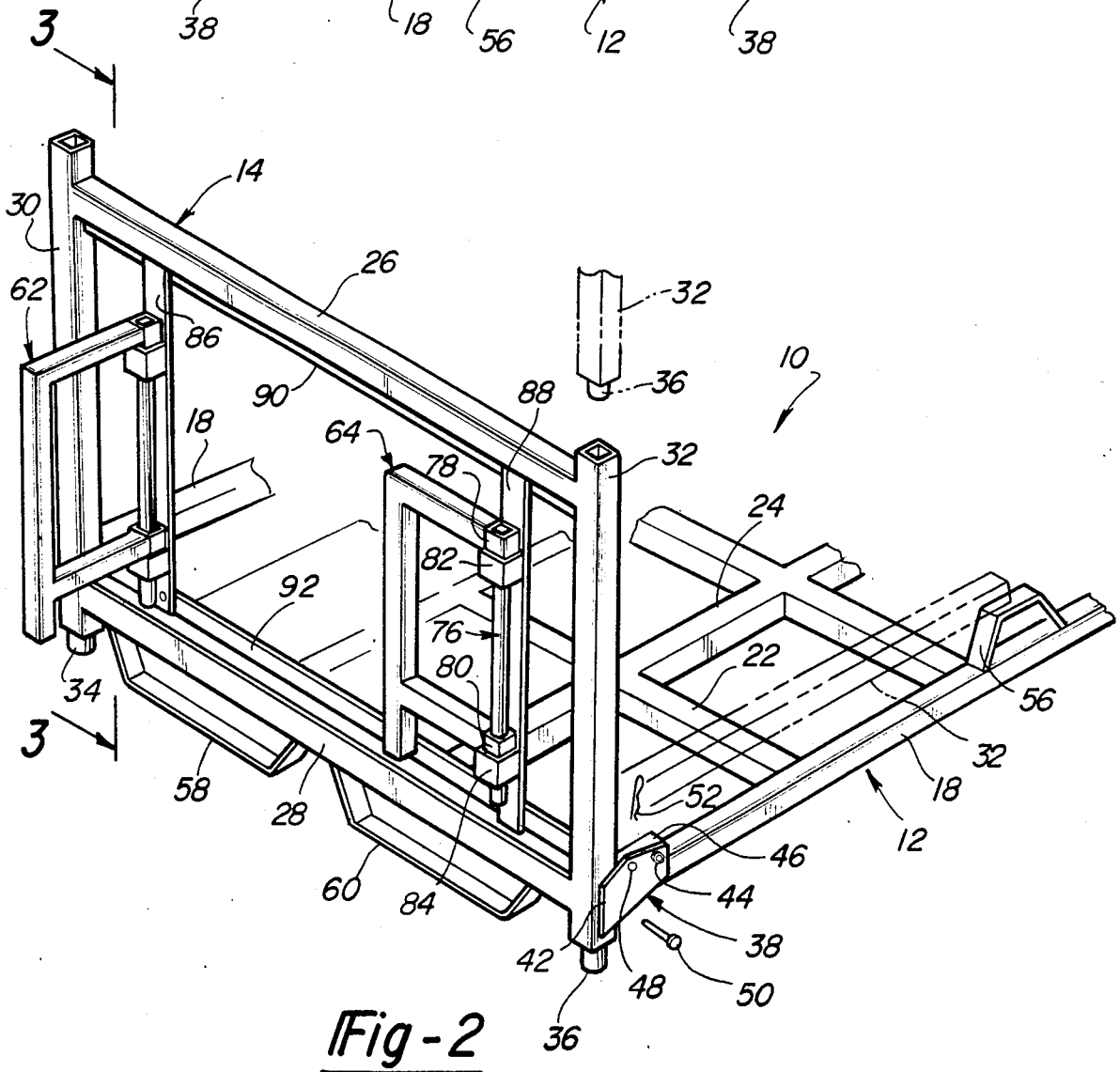
FIG. 2 is a perspective view of one end of the shipping rack of FIG. 1.
Figure 3:
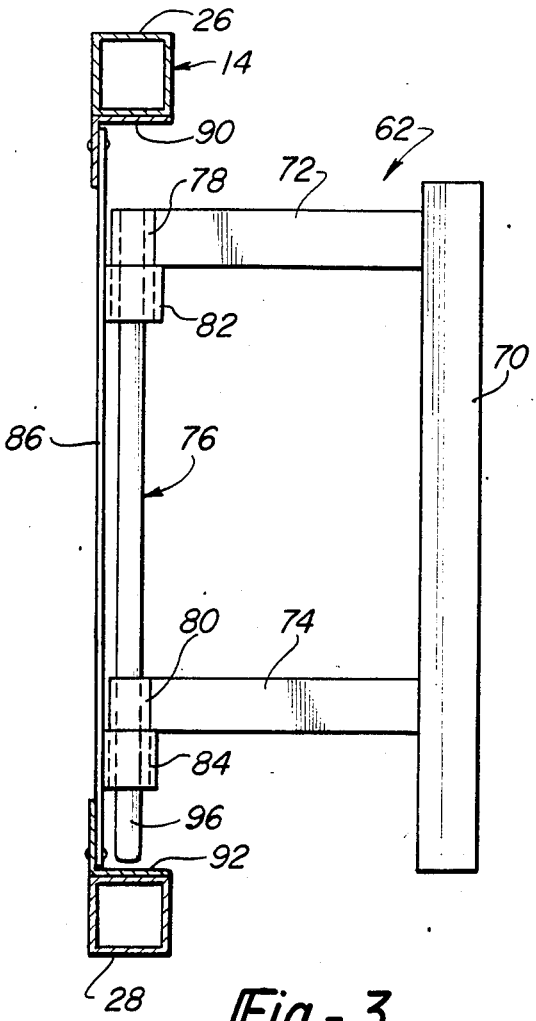
FIG. 3 is a sectional view taken substantially along the line 3—3 of FIG. 2 looking in the direction of the arrows.
Figure 4:
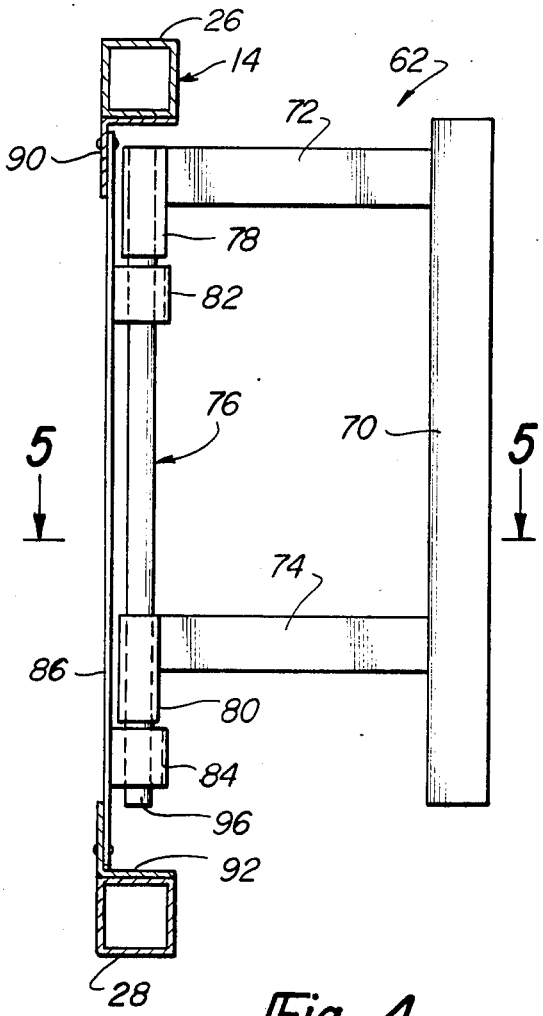
FIG. 4 is a view similar to FIG. 3 illustrating the rack extension in the raised position.
Figure 5:
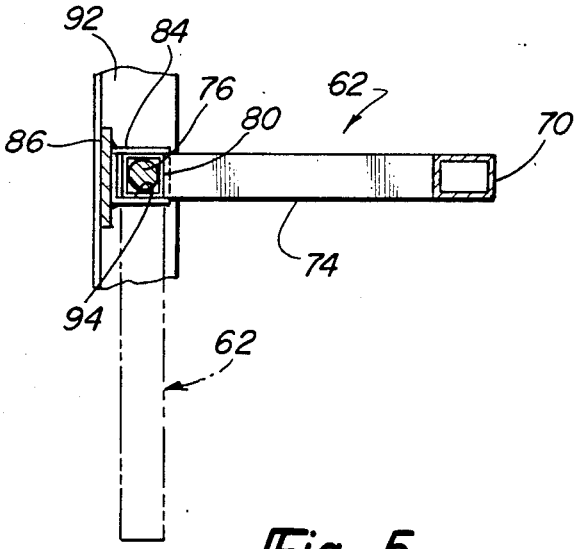
FIG. 5 is a sectional view taken substantially along the line 5—5 of FIG. 4 looking in the direction of the arrows.

The pivotal connection of the rack extensions to the end wall 14 is illustrated in FIGS. 3, 4 and 5. As thereshown, it will be noted that the extensions comprise a generally rectangular member formed of an outer upright tubular member 70 from which extend tubular cross members 72, 74. The members 72, 74 are connected to an elongated generally vertically extending edge member 76 which defines the inner edge of the extension. A pair of spaced part enlarged multi-sided locking elements 78, 80 are provided on member 76. Illustratively, the elements 78, 80 are square in cross section. A corresponding pair of vertically spaced apart tubular latching elements 82, 84 are provided on vertical struts 86, 88. It will be noted that the struts 86, 88 are inset with respect to the thickness of the sidewall tubular frame. The struts are connected at the top and bottom to horizontal angle members 90, 92 which are secured to the rails 26, 28. The insetting referred to results in the extensions folding into the end walls when they are pivoted inwardly as shown in FIGS. 2 and 5.

The edge member 76 of the extension, which is cylindrical in shape, is pivotally and vertically slidably received in the latching elements 82, 84. The locking elements 78, 80 are positioned above the latching elements 82, 84 when the extension edge member 76 is lifted upwardly as shown in FIG. 4. This permits pivoting of the edge member 76 in latching elements 82, 84, and thus the extension, to either of the positions shown in FIGS. 2 and 5.

The interior 94 of each latching element, as shown in FIG. 5, has a surface configuration which mates with the configuration of the locking elements to prevent pivoting of the edge member 76 when the locking elements are received therein upon downward movement of the edge element as shown in FIG. 3. Illustratively, the interior 94 of the latching elements is square. Thus, the extensions 62, 64 may be pivoted outwardly or folded into the end wall as shown in FIG. 2 and locked in whichever position is desired.

Stop means are provided to limit both upward and downward movement of the extensions. As will be appreciated from viewing FIG. 4, the insetting of the extension edge member 76 into the end wall results in the upper end of the member 76 abutting against the upper rail 26 upon upward sliding of the extension. This functions to stop such upward movement. The edge member 76 has an extended lower portion 96 to prevent escape from the latching element 84 prior to such abutment. Stop means which limit downward movement of the extensions comprise the upper and lower cross members 72, 74 which abut against the latching elements 82, 84 upon downward movement of the extension.

I claim:

1. A shipping rack convertible to a first rack length for snug lengthwise loading across the interior width of a semi-trailer and convertible to a second rack length for snug loading lengthwise across the interior width of a railroad boxcar, the rack comprising a bottom wall having a width and a length, an upstanding end wall at each end of the length of the bottom wall, the distance between the outside surfaces of the end walls defining said first rack length, a pair of spaced apart rack extensions pivotally mounted on one of the end walls, said rack extensions being pivotable to one position where they are folded into said one end wall to define wirh the end wall the first rack length and being pivotable to a second position where they extend outwardly from the outside surface of said one end wall in which position the distance between the outer edge surfaces of the extensions and the outer surface of the other end wall define the second rack length, and means to latch the rack extensions in either the first or second position.

2. A shipping rack as defined in claim 1, further characterized in that the first rack length is about ninety-six inches and the second rack length is about one hundred eight inches.

3. A shipping rack as defined in claim 1, further characterized in that one edge of each extension comprises an elongated generally vertically extending member having a pair of spaced apart enlarged multi-sided locking elements thereon, a pair of vertically spaced apart tubular latching elements mounted on said one end wall, said one extension edge being pivotally and slidably received in the latching elements with each of the locking elements being positioned above one of the latching elements when the extension edge is moved upwardly to pefmit pivoting of the edge in the latching elements, and thus the extensions, to either said first or second position, the interior of each latching element being of a size to slidably receive a locking element and having a mating surface configuration to prevent pivoting of the edge when a locking element is received therein upon downward movement of the edge, and stop means on each extension to abut against the latching elements to limit downward movement of the extensions.

4. A shipping rack as defined in claim 3, further characterized in the provision of additional stop means on said one and wall to abut against the extensions and limit upward movement of the extensions, the edge member of each extension having an extended lower portion to prevent escape from its respective latching element prior to such abutment with the stop means on said one end wall.

* * * * *